US006173931B1

(12) United States Patent
Johnson, Jr. et al.

(10) Patent No.: US 6,173,931 B1
(45) Date of Patent: Jan. 16, 2001

(54) POST CAP AND ACCESSORY DEVICES

(76) Inventors: Anderson F. Johnson, Jr., HCR 1 Box 445A, Deltaville, VA (US) 23043; Michael L. Johnson, 3705 Genesee Ct., Virginia Beach, VA (US) 23456; William E. Johnson, General Delivery, Bavon, VA (US) 23013

( * ) Notice: Under 35 U.S.C. 154(b), the term of this patent shall be extended for 0 days.

(21) Appl. No.: 09/131,016

(22) Filed: Aug. 7, 1998

Related U.S. Application Data

(63) Continuation-in-part of application No. 08/508,160, filed on Jul. 27, 1995, now Pat. No. 5,709,057.

(51) Int. Cl.[7] ..... F21V 21/08

(52) U.S. Cl. ..... 248/222.11; 248/207; 248/219.2; 248/221.11

(58) Field of Search ..... 248/219.1, 219.2, 248/218.4, 223.41, 224.51, 207, 219.4, 221.11, 222.11, 224.7; 52/301, 27, 40, 300

(56) References Cited

U.S. PATENT DOCUMENTS 971,226 * 9/1910 Turner ..... 248/219.2
2,664,977 * 1/1954 Starcevich ..... 52/301
3,927,315 * 12/1975 Werry ..... 248/223.41
3,928,894 * 12/1975 Bury et al. ..... 248/223.41
5,636,826 * 6/1997 Nakagaki et al. ..... 248/224.51
5,799,918 * 9/1998 Swinderman et al. ..... 248/219.1

* cited by examiner

*Primary Examiner*—Michael Safavi

(57) ABSTRACT

A post cap and accessory assembly for pilings. Continued development resulted in refinements for accessory mounting and security, and improved adaptability of the caps to varying piling diameters and non-piling applications. Single accessory mounts afford greater ability to satisfy individual accessory needs and combination brackets broadly increase the mountability of accessories. An extension bracket provides side and top mounting positions beyond the original positions. A special electrical design permits electrical accessories mounted to a grooved base and wired to its electrical contacts to repetitively engage and disengage mating contacts for power hookup provided within a winged pedestal base so that the electrical accessories attached to the grooved base may be quickly attached or removed as desired while leaving the winged pedestal permanently installed. Easily operated wire locks are provided on all accessory mounts and are instantly released by fingertip force. Screws at all accessory mounting positions can be deployed to prevent the instant removal of an accessory, thereby adding an increased security measure. Special sizing sleeves, installable in all caps, reduce the manufacturing costs of the caps and enhance the fitting of the caps to piling diameters. Other means allow the caps to be adaptable to non-circular shapes.

1 Claim, 9 Drawing Sheets

POST CAP AND ACCESSORY DEVICES

This application is a continuation-in-part of application Ser. No. 08/508,160 filed Jul. 27, 1995, now U.S. Pat. No. 5,709,057.

FIELD OF THE INVENTION

The invention is related to the field of marine pilings and in particular to protective caps for pilings and variations thereof for similar adaptations.

BACKGROUND OF THE INVENTION

This invention is a continuation of the discoveries associated with the developmental efforts of U.S. Pat. No. 5,709,057, dated Jan. 20, 1998, after that patent application was filed. The essence of that patent provides a piling or post covering now protected by the registered trade name "PILEKAP" wherein top and side winged pedestals and separately mountable bases allow for a wide variety of accessorial attachments. Since approximately 70 words are used in claim 1 of the above patent to define the subject piling cap and since the trade name PILEKAP is a registered trademark, the name PILEKAP® shall hereinafter be used as reference to that particular piling cap.

It was soon determined that the top and side mounted pedestals needed to be adapted from the PILEKAP configuration and reconfigured for adaptation to other non-piling structures such as pier decks, sides of pilings, stair railings and other horizontal and vertical structures in order to provide the means for a total system.

For example, if a pier owner desires to construct a safety rope railing from one PILEKAP to another using the rope attachment block 111 shown in FIG. 10g of the above referred patent, then a mounting means for the top and side pedestals other than a PILEKAP is required for continuing the rope railing to non-piling structures as described above.

Similarly, there are situations where the top and side winged pedestals are preferred to be mounted on the side of a piling rather than the top. An example would be where very tall pilings are in place so that access to the tops is difficult, and perhaps not desirable. In that case, top and side mounting winged pedestals in a bracket configuration can be utilized to mount virtually all of the PILEKAP mountable accessories.

Also, similarly, bracket configurations of the top and side mounting winged pedestals would be very useful on the top members of bulkheading where the piling tops are often flush with the timbers so that PILEKAPS are not installable.

There are numerous marine situations where it is preferable to use only the top mounting winged pedestals and its accessory base to promote safety and to deter theft. This top pedestal can be mounted on the stern gunwales of boats for the temporary mounting of boarding steps, ladders, ski ropes, rod holders, etc. When the top pedestal is mounted on work surfaces in a galley and its accessory base is applied to appliances such as food blenders, the safe operation of such appliances can be assured when a boat is underway. Because of the limited space on most boats, the same top pedestal could be used for the temporary attachment of items such as tool vices during boat repairs.

On the instrument deck, winged pedestals could be used for the quick attachment and detachment of the highly expensive instrumentation employed in the operation of many boats. These instruments often are easy targets for thieves due to their easy accessibility especially when covered only by canvas. Usage of the winged pedestal system allows a boat owner to quickly demount all valuable instruments at the end of a cruise and store them in the cabin area so they are out of sight. A specially designed winged pedestal and its accessories mounting base provides for automatic hook-up of electrical power when the base fully engages the winged pedestal. All top winged pedestals can be provided in either a fixed or a swivel style.

Two means of locking the top and side accessory bases onto their respective pedestals of a PILEKAP were presented in the above-referenced patent. Since that filing a very simple, strong and easily operable locking means has been developed. It incorporates a very strong stainless steel wire of spring quality that is formed to be permanently affixed to the periphery of each mounting base. It is easily deflected by a person's fingers to permit the slidable engagement of the base onto the winged pedestal. Once full engagement is effected, the wire form snaps to its relaxed position adjacent to the center of the pedestal edge, thus locking the base onto the pedestal. Release is effected by flexing the wire form sufficiently so that it glides on top of the pedestal during removal. Thus a very quick and reliable attach and detach means is provided which for most accessories is sufficient. However, where security is important, two screws affecting each base can be deployed to disable the quick release features.

For most accessorial applications, the single, top mounted winged pedestal surface of a PILEKAP is sufficient in size to provide a stable platform for top mounting accessories. There are, however, certain situations where a top mounted accessory may impose a severe load due to its overbearing size (such as a large fish-cleaning table). To compensate, a side pedestal can be used to mount a special extension bracket to provide an additional top winged pedestal in correct alignment with the first top pedestal so that two top mounting bases properly located on the underside of a large accessory can engage the two top pedestals with greater stability. The bracket may also provide an additional side mounting pedestal. This concept, hereinafter referred to as a top and side winged pedestal extension bracket, can be employed to provide at least five top and side pedestals and more are possible if additional extension brackets are used.

In another overbearing condition, such as in the support of a beach-sized umbrella, both the top and side pedestal positions of a PILEKAP can be utilized in combination to provide a supportive means stronger and more stable than either individually.

The PILEKAP devices protected by U.S. Pat. No. 5,709,057 and those devices disclosed in this application are intended to be manufactured by the injection molding of a plastic. Tooling for this mode of manufacture typically is quite expensive. For example, if the PILEKAPS are to be offered to the consumer in inside diameter sizes of 4, 5, 6, 7, 8, 9, 10, 11 and 12 inches, then nine separate injection molds would be required, the cost of which could easily reach into the upper six-figures. A concept is herein advanced which requires that injection molds only for the 6, 9 and 12 inch sizes would be necessary. Then, sizing sleeves with either ½ inch or 1 inch thick walls are fabricated with the proper outside diameters to fit snugly inside the injection molded inner diameter sizes. Thus, a 12-inch PILEKAP can be adapted to fit either an 11-inch or a 10-inch diameter piling, etc.

Many methods can be used to manufacture the sizing sleeves, but an inexpensive method of fabricating the sizing sleeves has been developed. Roofing felt normally is manufactured and sold in a 36 inch width and in rolls up to 144 feet in length. The 36-inch width is slit to a 6¾-inch width so that it is ¼ inch shorter than the 7 inch inside measurement of the PILEKAP sidewalls. After slitting, the felt is carelessly rewound to provide the different sizing sleeves described above. An adhesive, such as hot glue, is used to fasten both ends and is dribbled throughout the winding process to provide a tight and non-telescoping sleeve. An unexpected benefit resulted from this development. It was found that if a PILEKAP with a particular sleeve inside diameter produces too snug a fit onto a piling, the installer can score the innermost felt layer with a sharp blade and remove a sufficient amount for a proper fit so that on-the-job sizing is easily accomplished.

In marine construction, timbers are often vertically installed having normal cross-sectional dimensions of 4"×4", 6"×6" and 8"×8". For these applications, an internal adapter can be installed inside a PILEKAP to fit non-circular shapes.

SUMMARY OF THE INVENTION

Accordingly, it is an object of the present invention to provide devices to enhance and extend the usability of a PILEKAP.

It is another object of the invention to apply the PILEKAP concept of quickly and securely attaching and detaching accessories to winged pedestal bases affixed to structures and surfaces other than pilings and posts.

It is yet another object of the invention to provide devices that function in concert with piling mounted PILEKAPS to provide a continuous system where a piling may not exist for the continuation of a PILEKAP concept (i.e. rope railings attached to rope block bases mounted on PILEKAPS would need a winged pedestal that is suitable for attachment to structures where pilings do not exist).

Categorically, the devices of the invention consist of (1) a top mounting winged pedestal only, (2) a side mounting winged pedestal only, (3) a combination bracket with top and side mounting winged pedestals, (4) a device to couple the strengths of the top and side pedestals of a PILEKAP in order to support extreme loads and to provide the functionality of said pedestals at displaced positions, (5) a top winged pedestal with electrical contacts that engage polarized contacts of top mounting bases, (6) a wire lock affixed to the accessory bases for locking and unlocking said bases, (7) a security means to disable the wire locks, (8) sizing sleeves to allow a particular size (internal diameter) of a PILEKAP to be economically and functionally reduced to properly fit the outside diameters of smaller pilings, and (9) an adapter to permit a circular PILEKAP to fit non-circular shapes.

The preferred embodiments of the invention with regard to the pedestal mounting devices are as follows: (1) a single, top-mounting, winged pedestal, (2) a single, side mounting, winged pedestal, (3) a combination bracket configuration with a top mounting pedestal on the top surface and a side mounting pedestal either on the inside or the outside vertical surface, (4) a top and side winged pedestal extension bracket configuration wherein a top mounting winged pedestal is affixed to the top surface of a U-shaped bracket having the open end down and where a side mounting base is attached to the outside of one vertical surface and a side mounting winged pedestal is attached to the outside of the other vertical surface, (5) a top mounting winged pedestal equipped with electrical contacts which will engage similar contacts fabricated into a top mounting accessory base so that when disengaged there are no exposed live contacts but when engaged, instruments mounted and wired to the top mounting base can receive electrical and fiber optic signals from inputting circuits properly connected to the appropriate contacts located in the structural base of the top mounting winged pedestal, (6) a wire lock using a high strength spring wire affixed to the accessory bases for locking and unlocking said bases, (7) a security means to disable the release of the wire locks, (8) sizing sleeves to allow any internal diameter of an injection molded PILEKAP to be functionally reduced for the proper fitting of smaller diameter pilings, (9) the manufacturing technique of using continuous windings of roofing felt in order to produce said sizing sleeves which, during the installation of a PILEKAP, permit the user to remove the innermost windings, if necessary, to achieve a better fit onto a piling, and (10) internal adapters to allow circular PILEKAPS to fit non-circular shapes.

The single top mounting winged pedestal can be fastened to a surface with a single centrally located screw to swivel or be fastened with additional screws for a stationary mounting. The combination bracket will have the top mounting winged pedestal on the top surface and may have the side mounting winged pedestal on either the inside or outside vertical surfaces of the bracket. For these combination brackets, screw mounting is quite feasible; however it may be desirable to use steel bands for mounting the brackets at the intermediate height locations of pilings. The top and side winged pedestal extension bracket has a top mounting pedestal affixed to the top surface of a U-shaped bracket having the open side down with a side mounting base affixed to one outside vertical surface and a side mounting winged pedestal affixed to the other outside vertical surface so that when the side mounting base is attached to the side winged pedestal of a PILEKAP, the top mounting winged pedestal of the bracket is in alignment with the top mounting winged pedestal of the PILEKAP. Thus, a cantilevered load may be better supported.

Although two locking means were claimed in the above referenced patent, the wire bail lock herein described is simpler, stronger, has better manufacturability and is more consumer friendly. Mounted on the periphery of either the top or side mounting bases, the wire bail is either square or trapezoidal in order to match the peripheral configuration of the bases. The bails are mounted on the bases so that at rest, their position coincides with the horizontal centerlines of the edges of the respective mounting pedestal wings. To mount a base equipped with a wire bail onto a winged pedestal, the base is positioned so that the unconstrained side of the bail is adjacent to the leading edge of the pedestal wing. Then, with finger pressure deflecting the bail approximately 5/16 inch away from the centerline, each base is easily slidable onto its respective winged pedestal and a locking action is achieved when the base and its pedestal are fully engaged and the wire bail returns to its centerline (at rest) position.

The wire locking bails just described are a very practical means of attaching and detaching all of the PILEKAP accessories, both top and side mounting. However, they offer little resistance to meddling, tampering and vandalism. Therefore a means of providing an additional security measure for each accessory mounting base has been developed. Stainless steel screws are located on both sides of the leading edge of the top mounting base and at right angles to the base sides so that after the said base is fully engaged with the top mounting winged pedestal, the screws can be fully advanced toward the center so they become positioned against the supporting base of the top winged pedestal thereby preventing removal of the top mounting base even when the wire bail is lifted above the winged pedestal's top surface. For improving the security of side mounted accessories, a stainless steel screw is located at the base of each side pedestal wing, vertically positioned with the head completely flush so no interference is caused to the operation of the wire bail during normal operation. A non-obvious security lock is achieved when the wire bail is deflected toward the side of the PILEKAP, and during said deflection, the aforementioned screws are backed out sufficiently to prevent the return of the wire bail to its normal position, thus providing a very secure locking action. The compromising of either of these increased security measures by a vandal or a thief is tantamount to the similar thievery or vandalism of non-PILEKAP devices mounted with screws or other fasteners on other structures.

Typically, pilings used for piers at homes, campgrounds, clubs, resorts and marinas range in diameter from 4 to 12 inches. Commercial piling caps are usually offered in one-inch diameter increments. If PILEKAPS were to be injection molded of plastic for the nine diameters from 4 to 12 inches, an average cost of $90,000 per mold would result in an estimated cost of $810,000. Since the recovery of mold costs must be reflected as a costing increment in the total manufacturing cost of a product, an individual injection mold for each diameter size would cause each PILEKAP to be rather expensive. Therefore, it was decided to group the nine diameter sizes in the three diameter inch groups of (12, 11, 10), (9, 8, 7), and (6, 5, 4), and to injection mold only the 12, 9 and 6 inch diameter sizes. Then sizing sleeves with one half and one inch wall thickness and outside diameters equal to the inside diameters of the molded PILEKAPS could be inserted into the respective PILEKAPS and make them adaptable to the two small diameter sizes in each group. Many different techniques for fabricating these liners were explored but none approached the economy, practicality, weatherability and consumer friendliness of the method hereby presented. Roofing felt, a product manufactured for long life and weatherability as long as it is sheltered from the elements, is slit to a width slightly less than the internal vertical height of a PILEKAP. Then it is coreless wound on either 11, 10, 8, 7, 5 or 4 inch mandrels until the outside diameter of the winding diameter equals the inside diameter of the injection molded PILEKAP of each grouping described above. An adhesive such as hot glue can be interspersed throughout the winding process to achieve a stable, tightly wound, non-telescoping sleeve. These sleeves allow the adapted PILEKAPS to function as well as the molded PILEKAPS and have an additional advantage. If the initial fit of a molded PILEKAP onto a piling is a bit too snug, the piling's diameter must be dressed down for a proper fit. When a too snug fit is encountered with the laminated felt sleeves, the installer can easily enlarge the inside diameter of a given sleeve by scoring or cutting through the innermost laminations and then removing sufficient laminations to obtain an exact fit. The final cost of each sleeve is very low and the sleeve concept is impressive when one realizes that six sizing sleeves in the above scenario result in tooling cost savings of approximately one-half million dollars.

Often timbers of nominal sizes 4"×4", 6"×6", and 8"×8" are used in waterfront construction. If a circular PILEKAP is equipped with an internal adapter to fit those square sizes, then PILEKAP technology can be applied in those situations. It is possible to cast such an adapter directly inside a given PILEKAP using a removable core of the desired shape placed in the center and filling the created cavity with a pourable fiberglass mixture. Obviously, other adapter means may also be employed.

BRIEF DESCRIPTION OF THE DRAWINGS

The foregoing objects and other advantages of the present invention will be more fully understood from the following detailed description and reference to the appended drawings herein:

FIG. 1A top view of a single top mounting winged pedestal affixed to a supporting member by a single centrally mounted screw in order to permit said pedestal to swivel

DETAILED DESCRIPTION OF THE INVENTION

Figure 1A:
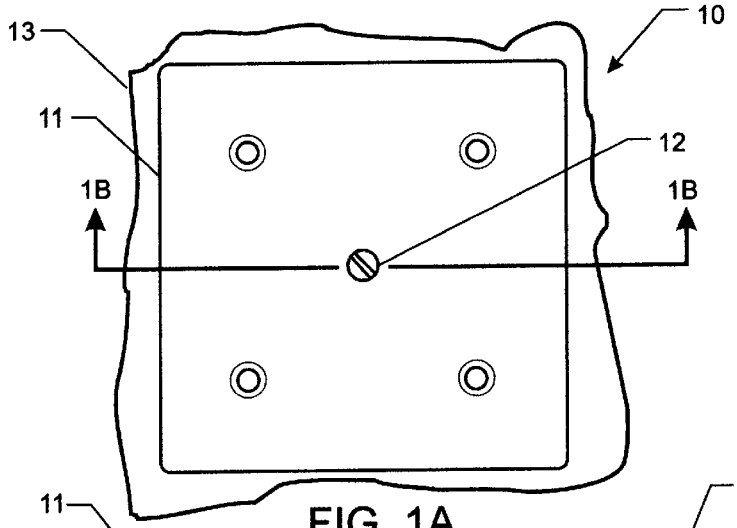
Figure 1B:
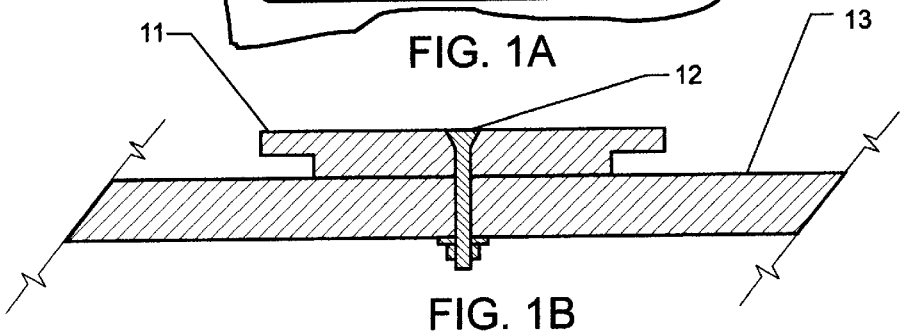
FIG. 1B is a sectional view of the same pedestal in FIG. 1A.
Figure 1C:
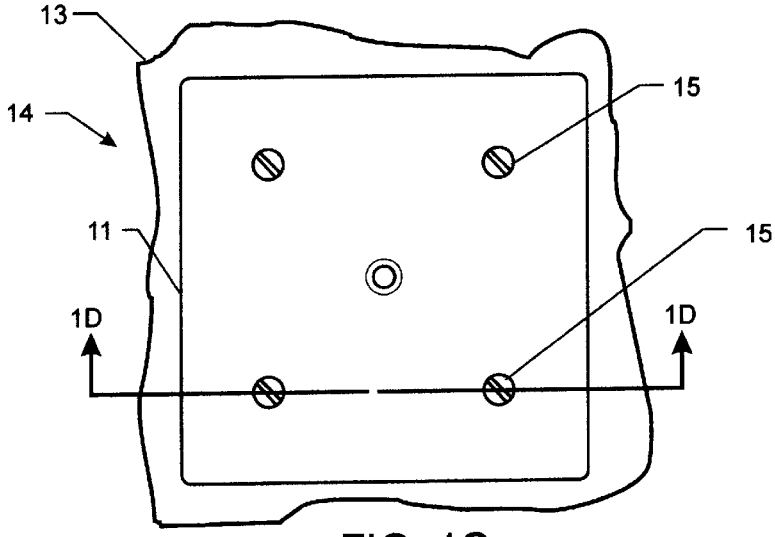
FIG. 1C is another view of the same pedestal in FIG. 1A attached with additional screws for a non-swiveling installation.
Figure 1D:
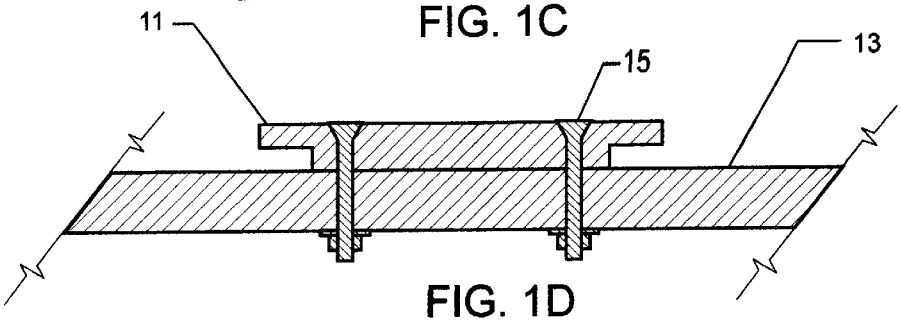
FIG. 1D is a sectional view of the same pedestal in FIG. 1C.

Referring now to FIG. 1A, a square winged pedestal 11 designed to act as a mounting fixture is shown attached to a base 13 with a centrally located screw 12 so that the winged pedestal 11 may swivel. FIG. 1B is a sectional view of FIG. 1A showing the configuration of the winged pedestal 11. In FIG. 1C, additional screws 15 are used to attach the winged pedestal 11 to the base 13, thus creating a non-movable installation. FIG. 1D is a sectional view. Either installation of the winged pedestal 11 forms a top-mounting fixture for accepting the top grooved accessory base 17 presented in Patent 5,709,057. Representative accessories for top mounting would be rope cleats, lamps, owls, and fish cleaning tables.

Figure 2:
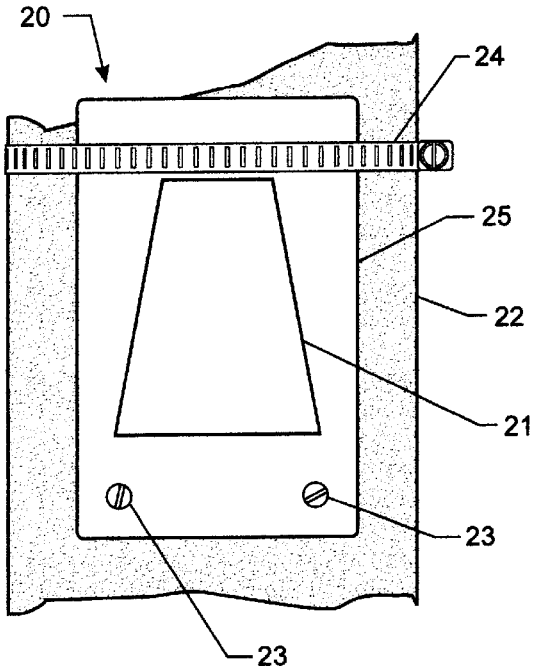
FIGS. 2 and 2A are front and side views of a single side mounting winged pedestal showing how it can be attached to the side of a piling with either screws or bands.
Figure 2A:
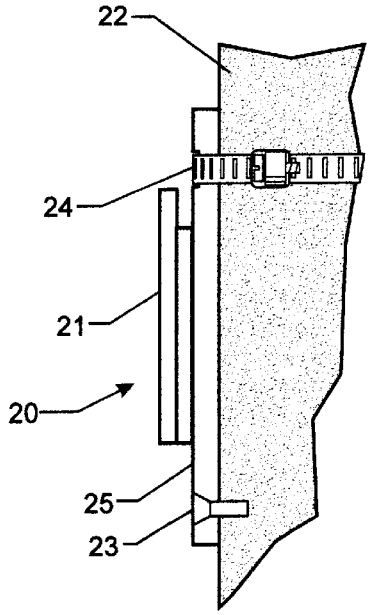

FIGS. 2 and 2A show the front and side views of a side mounting winged pedestal 21 affixed to an adapter plate 25, said plate attached to a piling 22 using either screws 23 or a band 24. Thus installed; the side mounting winged pedestal 21 will accept the side mounting grooved accessory bases 19 presented in U.S. Pat. No. 5,709,057. Representative accessories for side mounting would be ring buoys, fire extinguishers, hose hangers, electrical power centers and rope hangers.

Figure 3A:
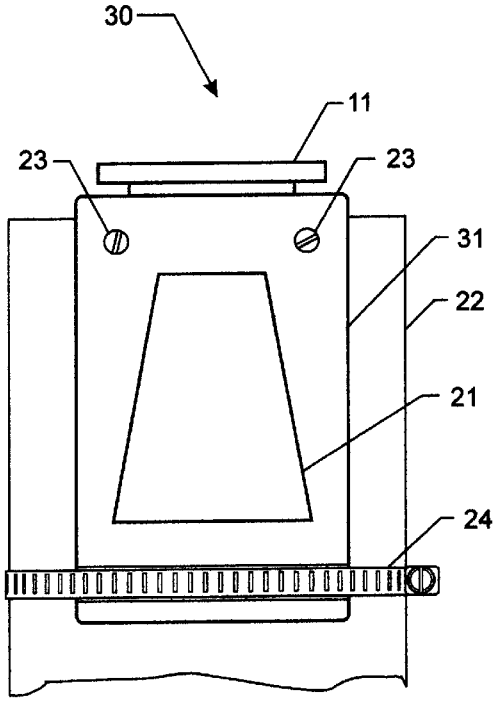
FIGS. 3A and 3B are front and side views of a combination bracket attached to the top of a piling, said bracket consisting of a top mounting winged pedestal installed on the top surface of the bracket and a side mounting winged pedestal installed on the outside surface of the vertical leg of the bracket.
Figure 3B:
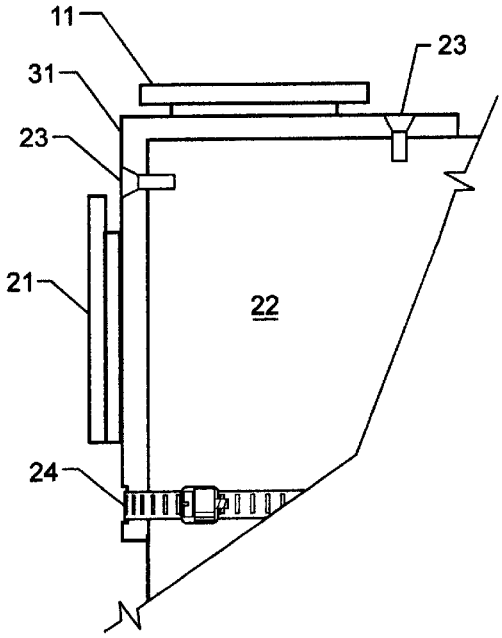

FIG. 3A and FIG. 3B show front and side views of a combination bracket 31 attached to a piling 22, a top mounting winged pedestal 11 attached to the top surface and a side mounting winged pedestal 21 attached to the outside of the vertical leg of the bracket 31. Either screws 23 or a band 24 affix the bracket 31 to the piling 22.

Figure 3C:
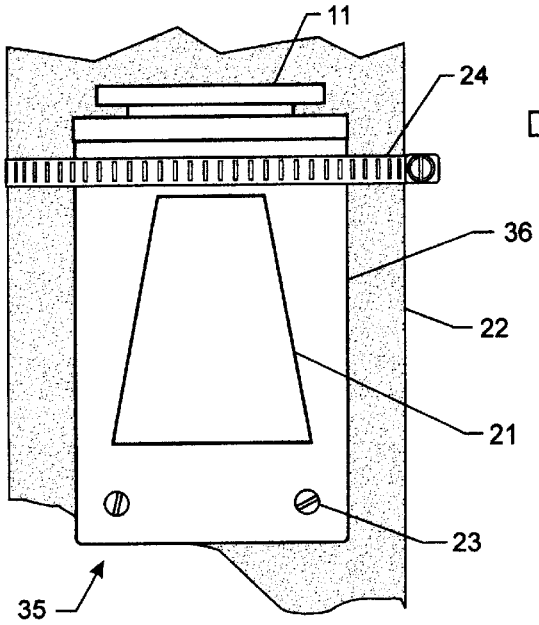
FIGS. 3C and 3D are front and side views of a combination bracket attached to the side of a piling and constructed similarly to FIGS. 3A and 3B except that the side mounting winged pedestal is installed on the inside surface of the vertical leg of the bracket.
Figure 3D:
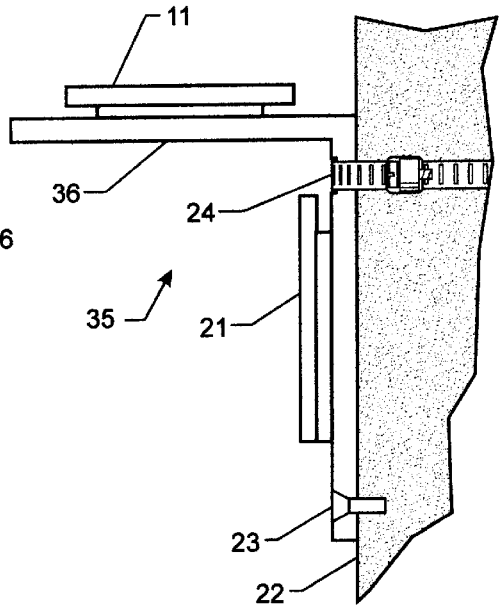

FIG. 3C and FIG. 3D show front and side views of combination bracket 36 attached to a piling 22 with a top mounting winged pedestal 11 attached to the top surface and a side mounting winged pedestal 21 attached to the inside of the vertical leg of the bracket 36. Either screws 23 or a band 24 affix the bracket to the piling 22.

Figure 4A:
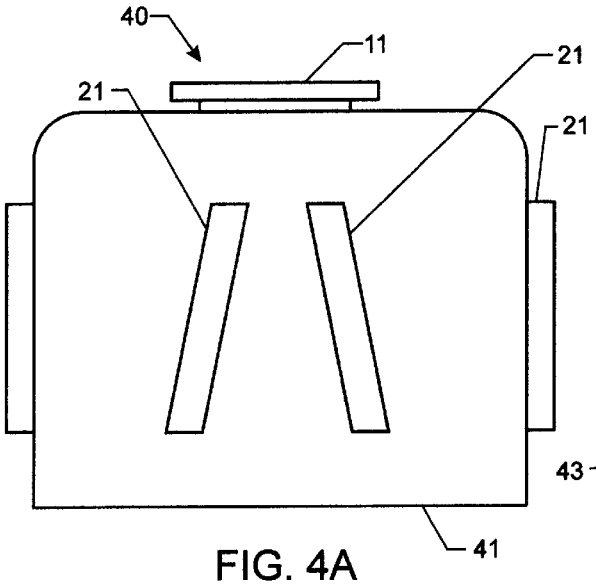
FIG. 4A is a side view of a typical PILEKAP showing the top and side winged pedestals.
Figure 4B:
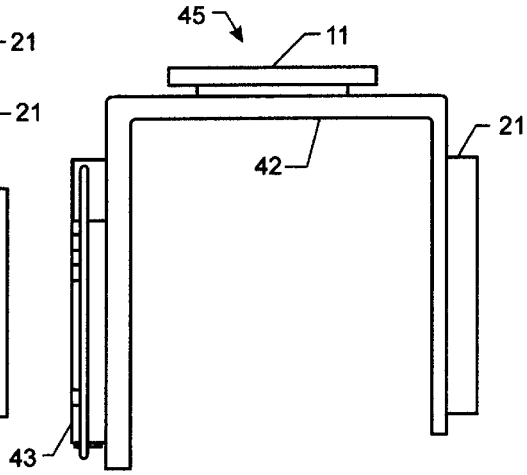
FIG. 4B is a view of a top and side winged pedestal extension bracket which is equipped with a top mounting winged pedestal on its top surface and a side mounting base on the outside of one vertical leg and a side winged pedestal on the outside of the other vertical leg.
Figure 4C:
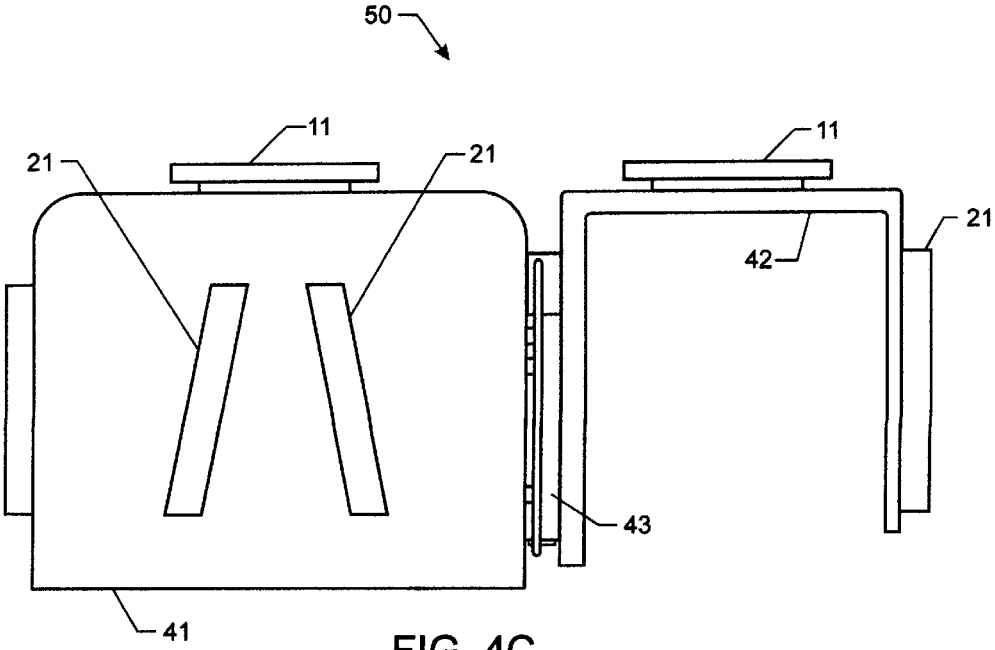
FIG. 4C is a view showing the extension bracket installed on the side winged pedestals of the PILEKAP thus providing two top winged pedestals in structural alignment and an additional side winged pedestal.

FIG. 4A shows a side view of a typical PILEKAP 41 featuring a top mounting winged pedestal 11 and side mounting winged pedestals 21. FIG. 4B shows a bracket 42 to which is affixed a top mounting winged pedestal 11 to its top surface and a side mounting accessory base 43 affixed to the outside surface of one vertical leg of bracket 42 and a side winged pedestal 21 on the outside of the other vertical leg. FIG. 4C shows how the assembly 45 of FIG. 4B has been connected via side mounting accessory base 43 to the side mounting winged pedestal 21 of PILEKAP 41, thus creating two aligned top mounting winged pedestals 11 in order to better support overbearing loads applied to top mounting winged pedestals 11. Thus configured, the extension bracket 42 when mounted to the PILEKAP 41 provides also an additional side winged pedestal 21.

Figure 5C:
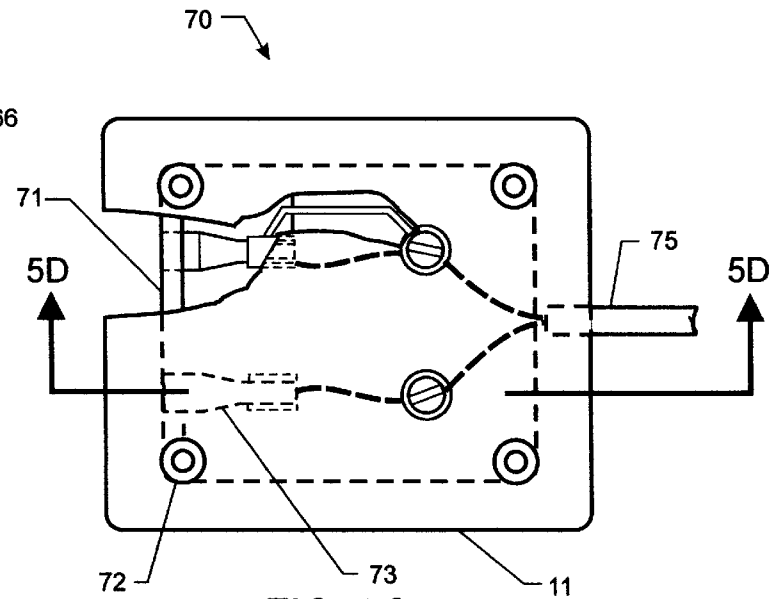
FIGS. 5C and 5D show a top and side sectional view of a top winged pedestal base equipped with female electrical jacks to receive the jack studs of FIGS. 5A and 5B, said female jacks communicating electrically with the indicated power supply.
Figure 5D:
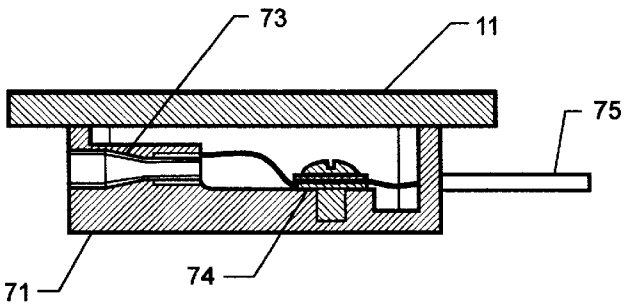
Figure 5A:
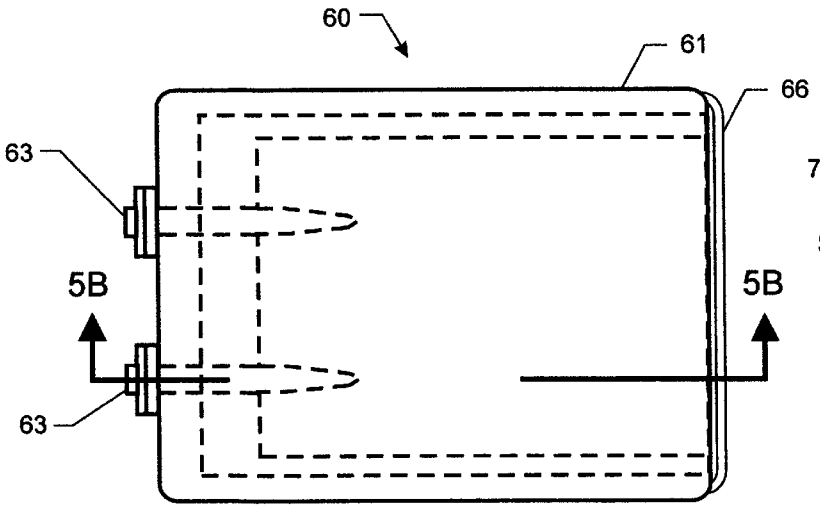
FIGS. 5A and 5B depict a top view and a side sectional view of a top mounting base which allows an instrument to be permanently mounted to its top surface and the instrument's wiring to be permanently affixed to the built-in electrical jack studs.
Figure 5B:
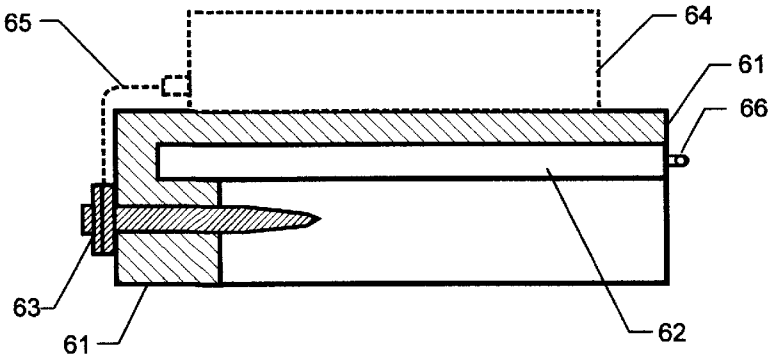

FIG. 5A and FIG. 5B are top and sectional views of a special version of a top mounting accessory base 61 equipped with a locking wire 66 and grooves 62 to accept a top winged pedestal 11, and jack studs 63 to accept the electrical wiring connections 65 of a variety of typical instruments 64 that may be permanently affixed to the top of the said base 61. FIG. 5C and FIG. 5D show top and sectional views of a special version of a pedestal box 71 affixed with screws 72 beneath a top mounting winged pedestal 11 and equipped with female jacks 73 which communicate electrically to terminals 74 to which power wiring 75 is supplied. In practice, the embodiment 70 could be permanently installed on the bridge of a boat and an expensive global positioning instrument 64 could be permanently installed on the said base 61, allowing the owner to quickly attach and detach the instrument 64 in the best interests of safekeeping. A locking spring 66 (the principle of which is fully explained in FIGS. 6A and 6B) provides for the secure attachment during engagement of the base embodiment 60 and the embodiment 70.

Figure 6A:
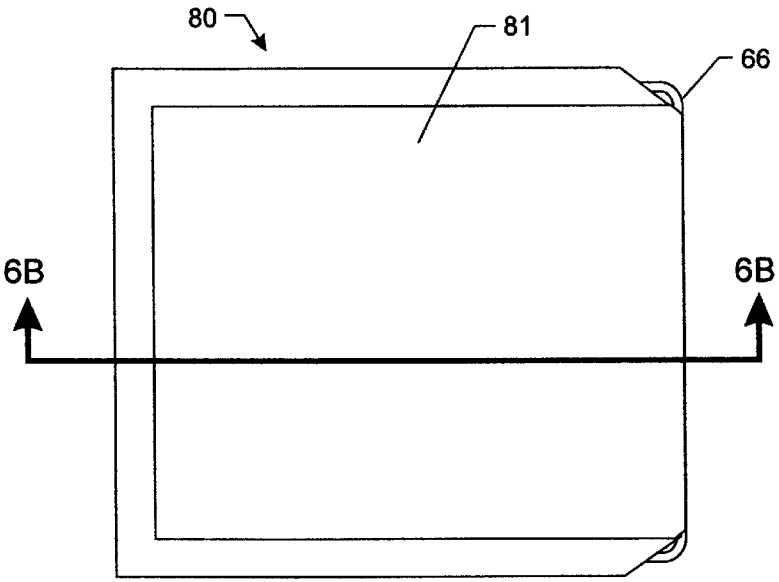
FIG. 6A depicts a top view of a top mounting accessory base equipped with a spring lock.
Figure 6B:
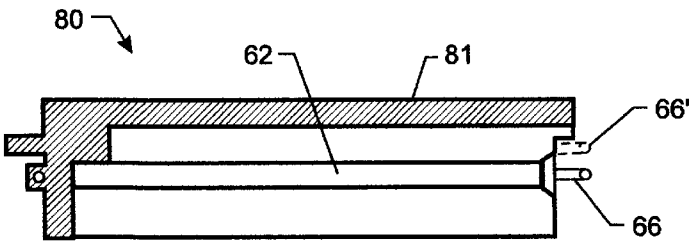
FIG. 6B depicts a sectional view of FIG. 6A showing how the spring lock's only movement is through flexure, said flexure above the top surface of a winged pedestal allows the top-mounting base to be either applied or removed from a winged pedestal.

FIG. 6A and FIG. 6B are top and sectional views of a top mounting accessory base 81 containing grooves 62 to mate with the winged pedestals of a top mounting winged pedestal 11 (shown in FIGS. 1A, 1B, 1C, 1D, 3A, 3B, 3C, 3D, 4A, 4B, 4C, 5C and 5D). A locking spring wire 66 is affixed to the periphery of said base 81 so that it's at rest position is in alignment with the centerline of grooves 62. FIG. 6B shows how flexural displacement of the spring 66' above the groove 62 allows a winged pedestal 11 to either enter or exit the grooves 62. After a winged pedestal 11 enters the grooves 62 to fill engagement with the base 81, the locking wire 66' returns to it's free position 66, thus locking the base 81 onto the pedestal 11.

Figure 7A:
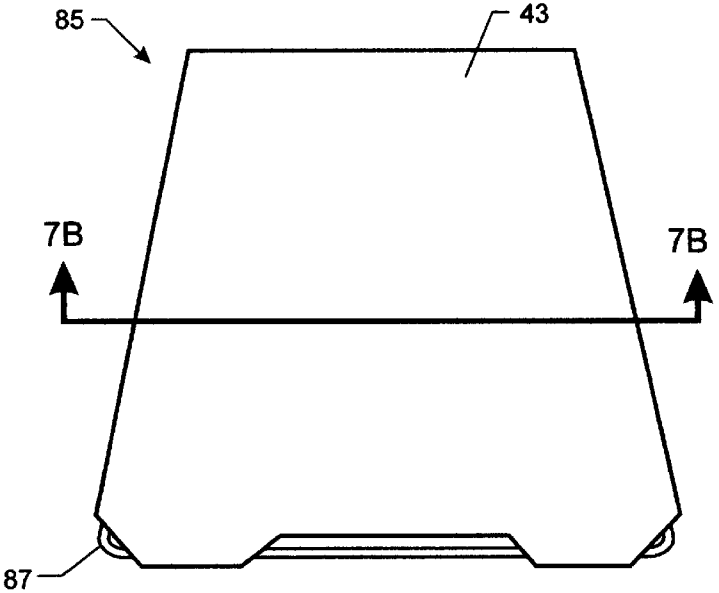
FIG. 7A depicts a side view of a side mounting accessory base equipped with a spring lock.
Figure 7B:
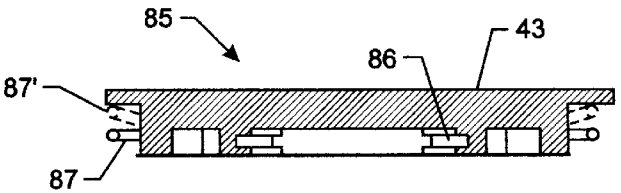
FIG. 7B is a sectional view of FIG. 7A showing how the spring lock's only movement is through flexure, said flexure beyond the outer surface of the side winged pedestals allows the side mounting base to be either applied or removed.

FIG. 7A and FIG. 7B are front and sectional views of a side mounting accessory base 43 containing grooves 86 to mate with the winged pedestals of a side mounting winged pedestal 21 (shown in FIGS. 2, 2A, 3A, 3B, 3C, 3D, 4A, 4B and 4C). A locking spring wire 87 is affixed to the periphery of said base 43 so that it's at rest position is in alignment with the centerline of grooves 86. FIG. 7B shows how flexural displacement of the spring 87' above the grooves 86 allows a side winged pedestal 21 to either enter or exit the grooves 86. The locking action occurs identically to that described above for the top accessory base 81 under FIGS. 6A and 6B.

Figure 8A:
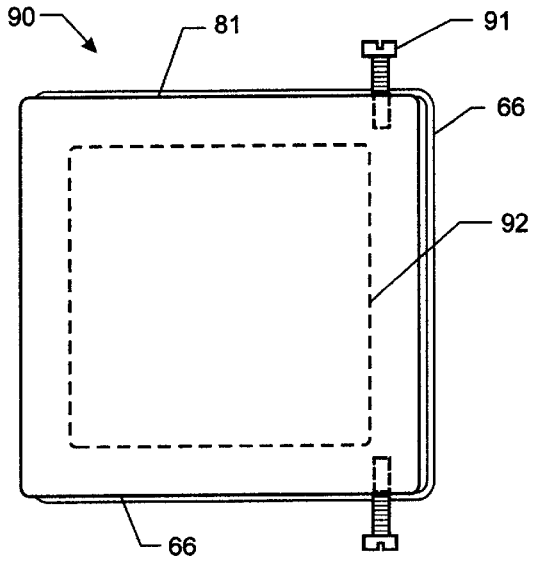
FIG. 8A is a top view of a top mounting base showing how screws are provided at the input end of the top mounting base and are shown in a non-engaged position, allowing free movement of the said base on and off a winged pedestal when mounted on a top winged pedestal.
Figure 8B:
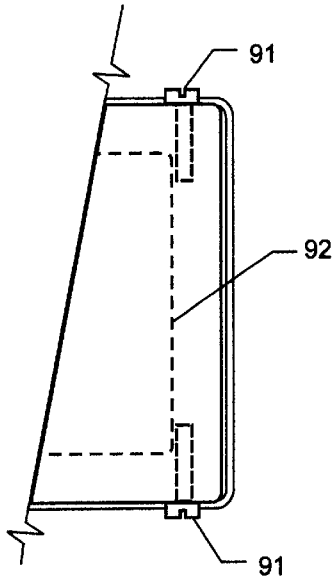
FIG. 8B shows the screws advanced toward the center of the top mounting base when mounted on a top winged pedestal thus blocking removal of the mounting base.

FIG. 8A shows a typical top mounting accessory base 81 equipped with two screws 91 oriented in the sides and near the open end of said base 81, so that advancement of the screws will be toward the center of said base 81. The screws 91 are positioned so that they do not interfere with the operation of locking wire 66. FIG. 8B show that fill advancement of the screws 91 places the ends of the screws 91 adjacent to the position 92 occupied by the base of the top winged pedestal 11 (See FIG. 4A) of a PILEKAP 41. With the screws 91 thus deployed, removal of base 81 is blocked until the screws 91 are withdrawn.

Figure 9A:
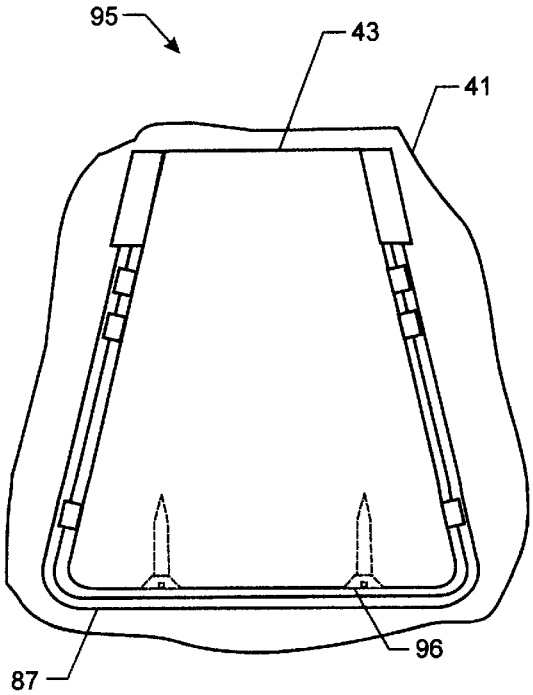
FIG. 9A and FIG. 9B are front and side views showing how flat-head screws are provided at the base of the side winged pedestals of a PILEKAP in an imbedded position allowing no interference with movement of the locking spring.
Figure 9B:
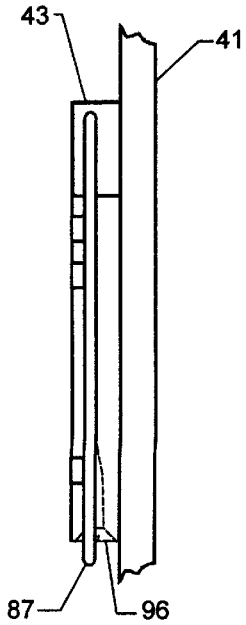
Figure 9C:
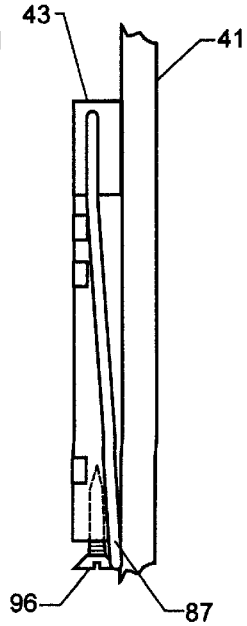
FIG. 9C is a side view showing how the locking wire can be held toward the wall of the PILEKAP while backing out the screws sufficiently to block the return of the locking wire, thus keeping the side mounting base locked in place.

FIGS. 9A and 9B show the front and side views of a typical side mounting accessory base 43 mounted on a side mounting winged pedestal 21 (See FIG. 4A) of a PILEKAP 41. Two screws 96, located at the bottom of the said pedestals 21 normally are recessed to offer no resistance to the movement of locking wire 87. However, if the owner desires to impede tampering or vandalism, the locking wire 87 is pushed past the screws 96 as shown in FIG. 9C, after which the screws 96 are backed out approximately ⅛", thus blocking the return of said wire 87 so that the side accessory base 43 can not be removed.

Figure 10B:
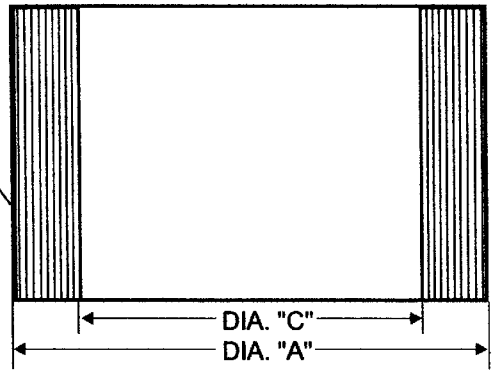
FIG. 10A and FIG. 10B are sectional views showing how diameters "B" and "C" of sizing sleeves can be achieved through coreless winding of roofing felt while maintaining a constant "A" outside diameter.
Figure 10A:
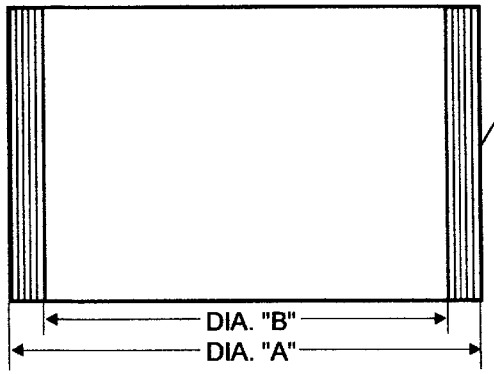
Figure 11B:
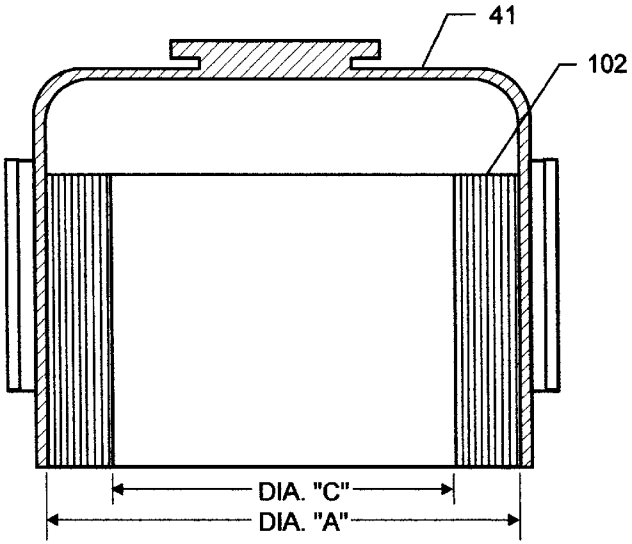
FIG. 11A and FIG. 11B are sectional views showing how the sizing sleeves of FIGS. 10A and 10B with inside diameters "B" and "C" are assembled inside a PILEKAP of "A" inside diameter to provide modified PILEKAPS to fit pilings with either "B" or "C" diameters.
Figure 11A:
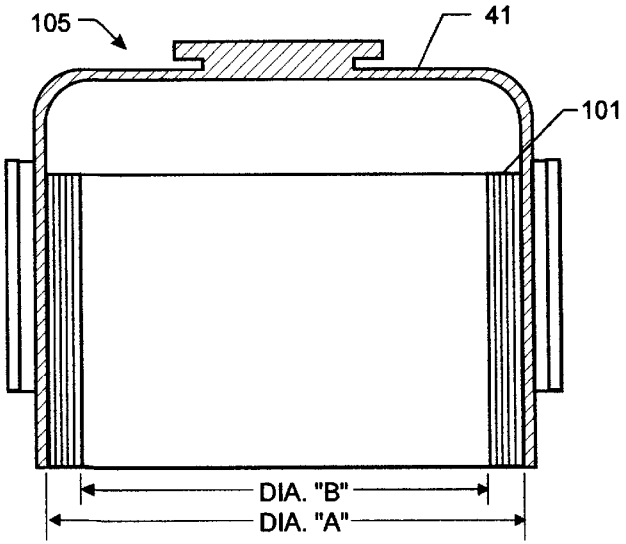

FIG. 10A shows a sizing sleeve 101 having an outside diameter "A" and an inside diameter "B", said sleeve 101 being corelessly wound using a sheet material such as asphalt saturated roofing felt. FIG. 10B shows another sizing sleeve 102, also corelessly wound with roofing felt to produce a greater wall thickness resulting in an inside diameter "C" while maintaining the same outside diameter "A" as in FIG. 10A. The two sizing sleeves 101 and 102 can then be press fitted into PILEKAPS 41 as shown in FIGS. 11A and 11B to produce internally modified PILEKAPS 41 that will fit pilings having outside diameters "B" and "C".

Figure 12:
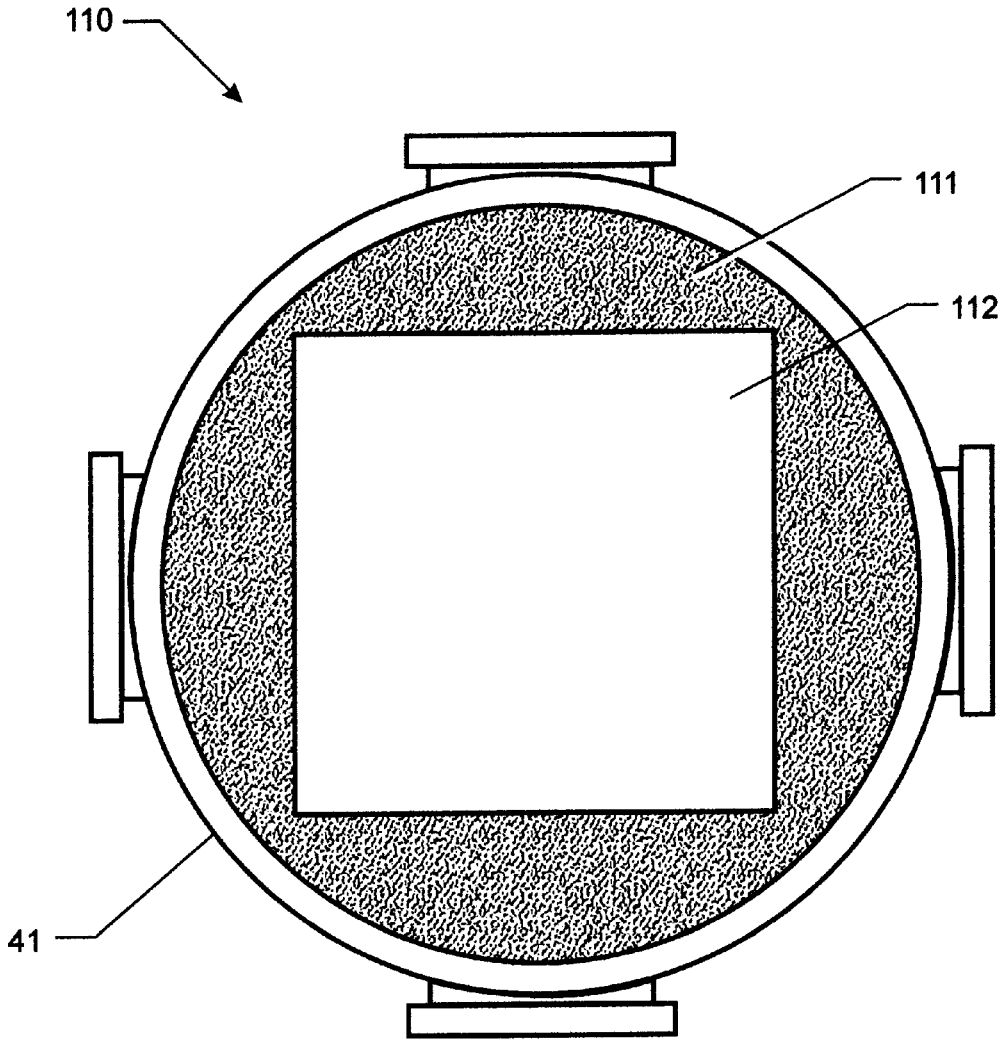
FIG. 12 is a bottom view of a typical PILEKAP equipped with an internal adapter to allow fitting to a squarish shape.

FIG. 12 shows the bottom view of a typical PILEKAP 41 wherein an adapter 111 is installed to convert the PILEKAP 41 to a non-circular adaptation 112.

Although the invention has been described relative to specific embodiments thereof, there are numerous variations and modifications that will readily be apparent to those skilled in the art in the light of the above teachings. Therefore, within the scope of the appended claims, the invention may be practiced other than as specifically described.

What is claimed as new and desired to be secured by Letters Patent of the United States is:

1. An accessory mounting base having a plurality of grooves, said base being equipped with a spring wire lock peripherally mounted so that the resting position of said wire is in alignment with the centerline of said grooves, thus through flexure of said wire, admittance of a winged pedestal is allowed so that at full insertion of said pedestal into said base, said spring wire returns to the resting position to lock the winged pedestal in place.

* * * * *